US007419329B1

(12) United States Patent
Tafoya

(10) Patent No.: US 7,419,329 B1
(45) Date of Patent: Sep. 2, 2008

(54) SEMI-SUBMERSIBLE DRY-DOCKING LIFT APPARATUS

(76) Inventor: Craig Allen Tafoya, 3778 SW 30th Ave., Ft. Lauderdale, FL (US) 33312

( * ) Notice: Subject to any disclaimer, the term of this patent is extended or adjusted under 35 U.S.C. 154(b) by 0 days.

(21) Appl. No.: 11/978,033

(22) Filed: Oct. 26, 2007

(51) Int. Cl.
*B63C 1/08* (2006.01)

(52) U.S. Cl. ..... 405/3; 405/4; 405/196; 405/218; 405/221; 114/44

(58) Field of Classification Search ..... 405/1, 405/3, 4, 7, 195.1–200, 218–221; 114/44
See application file for complete search history.

(56) References Cited

U.S. PATENT DOCUMENTS

| | | | | |
|---|---|---|---|---|
| 7,055,449 | B2 * | 6/2006 | Brown | 114/263 |
| 2004/0258483 | A1 * | 12/2004 | Vatsvag | 405/203 |
| 2007/0243024 | A1 * | 10/2007 | Foo et al. | 405/196 |

* cited by examiner

*Primary Examiner*—Tara L. Mayo
(74) *Attorney, Agent, or Firm*—Dorothy S. Morse

(57) ABSTRACT

A portable marine lift capable of multi-directional off-loading of yachts, ships, and other marine vessels at ground level to dry-dock them. It is compact and barge-like, and can be shared by independent shipyards, or used to expand the work area within a single port facility or shipyard. It is also self-contained when fitted with generators and/or propulsion means via add-on pods, and comprises independent platform sections joined together to meet any hull design, length and water depth. Platform sections have the ability to submerge, and may also be employed to capture and temporarily contain environmentally hazardous materials commonly produced by shipyards. In addition, the platform sections are preferably open-framed for weight savings. Computerized lifting, via multiple lift modules secured to platform sections, assures lifting of vessels in substantially level orientation. Optionally, platform sections can be configured for shallow water operation, with locking devices, and/or guides usable for off-loading railway alignment.

19 Claims, 3 Drawing Sheets

SEMI-SUBMERSIBLE DRY-DOCKING LIFT APPARATUS

CROSS-REFERENCES TO RELATED APPLICATIONS

None

BACKGROUND OF THE INVENTION

1. Field of the Invention

This invention relates to the marine industry and the ability to dry-dock large vessels in various ports, harbors, shipyards, and other marine facilities, specifically to a compact, self-leveling, and barge-like marine lift of efficient and expandable design that is capable of multi-directional off-loading of yachts, ships, and other marine vessels at ground level to dry-dock them. The present invention dry-docking lift apparatus can be portable and is designed to be taken to remote areas where haul-out facilities do not exist, and to also be used in any shore facility where space is limited. Further, the present invention has the advantage of self-containment for both local and remote use when it is fitted with a generator and/or means of propulsion (preferably in the form of add-on pods). In addition, since the costs of its manufacture and operation are lower than for many other structures and equipment used for marine vessel lifting purposes, and it does not require dedicated space, sharing the present invention between two or more shipyards is viable option for smaller facilities. The present invention design and construction allows for use of prime dockage at seawalls and piers, which is in contrast to other currently known units, such as the Synchrolift® elevator system, conventional railway systems, and mobile travel-lift units, which all have limited mobility at best and/or require a significant amount of dedicated space. The present invention also can be configured for multi-directional off-loading of a marine vessel at ground level via one or more of the following, a rail and cradle system, wheeled trailer-cradles, and an air-bearing or air-caster system, although not limited thereto. Since the present invention marine lift comprises independent platform sections joined together to meet any hull design, hull length, or water depth relating to large and small marine vessels, expansion or reduction of the present invention for differing uses is simple to accomplish and most qualified shipyards that would use the present invention will have the capability of adapting the platform sections and lift modules (also referred to herein as lift pods or lifting pods) for specific needs in a timely manner. Once the proper size of the present invention is formed, typically using two or more platform sections welded to one another but not limited thereto, and further when a sufficient number of lifting modules (or pods) are associated with the platform sections to successfully accomplish the raising and lowering of maximum anticipated loads during its use, the present invention can then be submerged simply by allowing the platform sections to fill with water. When the platform sections reach a depth sufficient to clear the bottom of a marine vessel hull that needs to be lifted to dock/seawall level, the marine vessel is moved into position over them, as well as shipyard-supplied cradle apparatus units positioned on the platform sections that will be used to maintain the marine vessel in a substantially upright orientation during the time it is out of the water. When the marine vessel in proper position, various conventional means of evacuating water from the platform sections can be used to raise them until the supported cradle apparatus comes into contact with the hull bottom.

Then, once there is certainty that the marine vessel is adequately supported on the shipyard's cradle assembly, computerized lifting of the cradle assembly, the supported vessel, and the platform sections to dock/seawall level can begin via conventional jacking units located in the present invention's lifting pods. Marine vessels usable with the present invention dry-docking lift system are typically large and require an operating depth greater than the minimum depth needed for present invention use, therefore water depth issues are usually not a concern in present invention applications. However, as needed or desired, shallow water operations of the present invention can sometimes be facilitated by the optional presence of a recessed center section, which can be permanently formed (integrated) in the top surfaces of platform sections during their manufacture, or created as a result of removal of one or more reversibly detachable structural members. In addition, one or more platform sections of the present invention can be optionally configured for temporary containment of hazardous materials, such as harmful paint chippings, sand blasting debris, and other materials that result from work performed on marine vessels during their yearly dry-docking periods. Periodically, according to need or convenience, the hazardous materials would be withdrawn from their temporary storage location in the present invention and transported to facilities where they can be treated and recycled, or otherwise safely disposed of, thus allowing the shipyards in which it is used to become more environmentally safe. Further, unlike all other dry-docking units in current use, the ability of the present invention to be lowered to a harbor or shipyard seabed in the event of a severe storm, hurricane, or tidal surge provides the additional benefit of substantially reducing the possibility of damage or destruction to it and any marine vessel secured to it while it is submerged.

2. Description of the Related Art

Lifting a marine vessel out of the water for dry-dock maintenance and repairs has typically been expensive and required permanently-installed elevator systems, dedicated space, or both. Other disadvantages in using prior art dry-docking systems for marine vessel maintenance and repair operations include the inability to contain and/or safely dispose of environmentally hazardous materials that are generated, and difficulties involved in bringing a marine vessel to ground level, when needed. The graving dock is typically a narrow basin having a cradle that will ultimately support the marine vessel, which is floated into it through one end. Once the marine vessel is in proper position, a gate is closed and the water is pumped out, leaving the vessel supported on the cradle. Since the graving dock is substantially a hole in the ground, its disadvantages include the need for significant dedicated space and no mobility. Also, hazardous materials generated during maintenance and repair operations in a graving dock can easily find their way back into the environment when the gate is again opened to release the vessel. Another dry-dock configuration is the floating U-shaped dry dock. It has floodable buoyancy chambers that sink when valves are opened. After reaching an appropriate depth, a marine vessel can then be moved into it. Thereafter, when water is pumped out of the buoyancy chambers, the U-shaped dry dock floats and allows work to be conducted on the vessel's outer hull. The floating dry dock has a mobility advantage and can be used for ship maintenance or repair in remote locations. However, several significant disadvantages include instability and the difficulty in transferring a marine vessel to ground level, when needed. A sinker-lift platform is a third dry dock option. After its installation, it becomes part of a permanent structure extending out into the water and includes a vertically movable flat platform that can be lowered to allow positioning of a marine vessel upon a cradle, and then subsequently raised to ground level where the vessel and the cradle supporting it in concert can be off-loaded via a rail system. Multiple hydraulic motors located on both sides of the movable platform (at ground level) provide for its up and down vertical deployment, with the hydraulic motors being secured to immobile structure adjacent to the movable platform that guides it during its vessel raising and lowering operations. Disadvantages of sinker-lift platforms include a high installation cost, high maintenance costs, a large amount of dedicated space, non-portability, and potential interference with movement of other marine vessels in a shipyard or adjacent shipping lanes. A slipway can also be used to remove marine vessels from the water to a dry dock, which typically occurs most easily at high tide. Slipways comprise an inclined plane (ramp) that extends into the water. At high tide a marine vessel can be floated onto a cradle supported by the slipway, after which electric or electric-hydraulic winches haul the marine vessel out of the water. Although it is less expensive than other options, it has the disadvantages of requiring a significant amount of dedicated space, immobility, and possible infringement on water rights in narrow channels. In contrast, the present invention lift apparatus overcomes all of the disadvantages mentioned above for prior art marine lift systems. It can be portable, as well as adapted for self-contained transport and use with the addition of one or more generators and/or means of propulsion (preferably via the addition of add-on pods). It is designed to be taken to remote areas where haul-out facilities do not exist, and where space is limited in shore facilities. Add-on power supplies can provide power in remote locations where it would otherwise be unavailable for needed maintenance or repair work. The ability to share the present invention between shipyards is also a benefit for smaller facilities. In addition, the present invention has the ability to be configured for multi-directional off-loading by means of, but not limited to, a rail and cradle system, wheeled trailer-cradles, and an air-bearing or air-caster system. Further, independent platform sections allow the present invention to be configured according to need to meet any hull design, length and water depth. Once the proper size of the present invention is formed from assembled platform sections, and an appropriate number of lifting pods are associated with the platform sections, the present invention is simply submerged by allowing the platform sections to fill with water. Various conventional means of water evacuation can then be used to raise the platform sections until the shipyard-supplied cradle units supported upon them come into contact with the vessel's hull. Once the vessel is securely positioned on the cradle, the lift pods associated with the platform sections work in concert to raise them, the vessel, and the cradle units to ground level, while assuring substantially level orientation of the marine vessel. Another advantage of the present invention over all of the prior art is its ability to be lowered to a harbor or shipyard seabed in the event of a severe storm, hurricane, or tidal surge, whereby damage and destruction are at least significantly reduced, or eliminated. In addition, one or more of the present invention platform sections can optionally be configured for temporary containment of harmful paint chippings, sand blasting debris, and other materials that are removed from marine vessels during yearly dry-docking periods. No dry-docking lift apparatus is known that has the same structure or all of the advantages of the present invention.

BRIEF SUMMARY OF THE INVENTION

The primary objective of this invention is to provide a portable, compact, and barge-like marine lift capable of multi-directional off-loading of yachts, ships, and other marine vessels at ground level to dry-dock them. It is also an object of this invention to provide a dry-docking lift apparatus that is expandable to accommodate marine vessels of differing length. Another objective of this invention is to provide self-leveling computerized lifting of marine vessels. Yet another objective of this invention is to provide a dry-docking lift apparatus that can be self-contained when fitted with one or more generators and/or propulsion means so that it is easily moveable between one or more nearby shipyards, as well as easily moveable to remote areas without the assistance of another marine vessel or the need for a local power supply once reaching its destination. It is a further objective of this invention to provide a dry-docking lift apparatus that may also be employed to capture and temporarily store the environmentally hazardous materials that are produced by all shipyards. It is also an object of this invention to provide a dry-docking lift apparatus with its platform sections preferably having an open-framed construction for weight saving transport.

When properly manufactured and used, the present invention marine lift apparatus provides a portable barge-like marine lift that can be configured for multi-directional off-loading (from at least two directions) of yachts, ships, and other marine vessels at ground level to dry-dock them via a rail and cradle system, wheeled trailer-cradles, or an air-bearing or air-caster system (which are only provided as examples and not intended to be limiting language). Further, any rails used with the present invention platform sections can be recessed to allow implementation of other transfer systems without interference. Multiple rails can also be added, so that several shipyards can share it, a useful option for shore facilities with limited space. In addition, since its use options are so much more varied and flexible than prior art lifts, the present invention can reconfigure a shipyard and make its scheduling easier. Many means of locating and aligning the present invention to various railways, seawalls, Ro-Ro vessels, or other fixed structures can be added, as required for off-loading of marine vessels. Further, if used frequently at a particular shipyard with a soft seabed, one or more pads of concrete or other materials (or blocks) can be positioned on the soft seabed to reduce sinking of one or more of the leg structures downwardly-extending from each present invention lifting module (also referred to herein as present invention 'lift pod' or 'lifting pods'). Its barge-like construction is easy to build and it can be removed from the water for routine and other maintenance. Also, if one of its legs needs replacing, the present invention can be jacked up without a load and the leg replaced without removing the present invention from the water. Thus, in addition to enhanced mobility, the cost of operating the present invention is lower than other known dry-docking lift systems. Multiple platform sections can be joined together to expand the present invention marine lift to accommodate vessels of differing length, although at some point width would also have to be expanded as marine vessel size increases. The present invention is also self-leveling through use of conventional means, which allows for automatic adjusting of each lifting module (lift pod) in the event of a soft or uneven seabed. Self-leveling means could include one or more sensors on each leg that identify its current load, and if one legs sinks too much into a soft bottom as indicated by increased load measurement, the sinking leg is promptly extended to maintain the supported marine vessel in a substantially level orientation. Further, adding one or more generators and/or propulsion means (preferably via add-on pods) to the present invention can make it self-contained so that it is easily and frequently moveable between one or more local shipyards, or transport to a remote area for use without needing to rely on local power supplies. A hydrodynamic bow section can also be used with the present invention, if needed to better tow the invention over long distances and during extreme sea conditions. In addition, it can be used in remote areas for salvage work to assist in the recovery of sunken vessels, while still having the capability to raise the marine vessel above the water for fast and efficient hull repair. Also, due to its portability and when overhead clearances allow, the present invention can be used in covered facilities. The present invention also allows dry-docking in covered facilities where cranes cannot operate. To avoid contamination of surroundings during maintenance and repair work on a supported vessel, tanks mounted to or an integrated part of the platform sections can optionally be used to collect toxic materials as they are generated, and the temporarily store such materials until environmentally protective disposal thereof can be achieved. Prior to collection, the immediate work area would be enclosed, and toxins captured by pumping them into one or more tanks. However, it should be recognized that the use of integrated tanks for hazardous materials containment can conflict with the open-framed structure preferred for weight-reduction and cost-effective transport to remote locations. Thus, the present invention is easily portable and can be used for any hull design, length and water depth. Further, the present invention allows the use of prime dockage at seawalls and piers, while all other currently known units, such as the Synchrolift® elevator system, conventional railway systems, and mobile travel-lift units, have limited mobility and/or require dedicated space. Expansion of the present invention for use with a larger vessel simply requires the welding of one or more additional platform sections to the structure in its current form, and most qualified shipyards that are contemplated for use of the present invention should have the capability of extending the platform and lift modules (or pods) according to need. Further, unlike all other dry-docking units in current use, the ability of the present invention to be lowered to a harbor or shipyard seabed in the event of a severe storm, hurricane, or tidal surge substantially reduces the possibility of damage or destruction. One additional use of the present invention is placement or alignment with various areas of a shipyard seawall or bulkhead to expand the workable areas or capacity of a shipyard or port facility.

The description herein provides preferred embodiments of the present invention dry-docking lift but should not be construed as limiting its scope. For example, variations in the number, placement, size, and configuration of lift pods; the length, width and height dimensions of the platform sections; whether the platform sections have a weight-saving open structure; the number of buoyancy tanks used, the number of optional hazardous storage tanks used; and the size and configuration of the optional recessed center area, other than those shown and described herein, may be incorporated into the present invention. Thus the scope of the present invention should be determined by the appended claims and their legal equivalents, rather than being limited to the examples given.

DETAILED DESCRIPTION OF THE INVENTION

Figure 1:
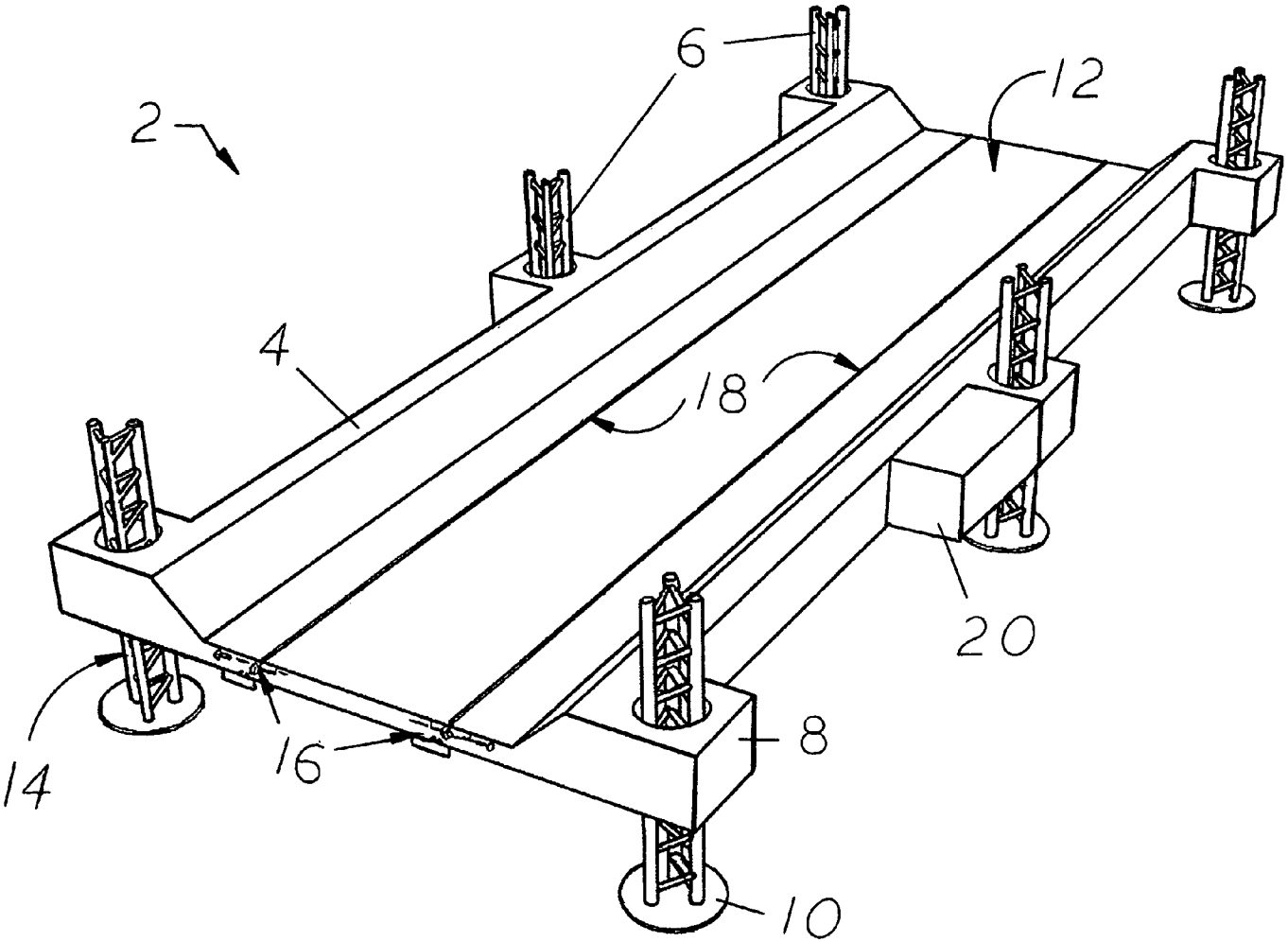
FIG. 1 is a perspective view of the most preferred embodiment of the present invention having one platform section, six lift pods, a recessed center area for shallow water operation, longitudinally-extending off-loading rails, one add-on propulsion pod, and locking devices for adding on additional platform sections prior to welding or securing platform sections to adjoining immobile off-loading structure.

The present invention comprises at least one platform section 4 and a plurality of lift modules (or lift pods) 6 to provide a compact, self-leveling, and barge-like dry-docking lift 2 that can be used for multi-directional off-loading of yachts, ships, and other marine vessels (such as but not limited to vessels 26 in FIGS. 2 and 3) at ground level to dry-dock them. Its efficient and expandable design can be adapted with various vessel supporting apparatus, including but not limited to the following, a rail 18 and cradle 22 system, wheeled trailer-cradles (not shown), and an air-bearing or air-caster system (not shown), and multiple independent platform sections can be joined together to meet any hull design, length and water depth, thus making expansion for new uses simple and easy. The present invention dry-docking lift 2 can be portable and possibly self-contained if fitted with one or more generators and/or means of propulsion via add-on pods. It is designed to be taken to remote areas where haul-out facilities do not exist, used where space in shore facilities, used to expand workable areas or capacity of a shipyard or port facility, and sharing by different shipyards. An important advantage is that this invention allows the use of prime dockage at seawalls and piers, and does not require dedicated space. Once the proper size for the present invention dry-docking lift 2 is determined, multiple platform sections 4 are secured together and welded. The number of lifting pods 6 is then selected and associated with the platform sections 4 to accommodate the maximum anticipated load. Then, submersion can be achieved simply by allowing the platform sections 4 (or tanks therein, such as but not limited to the tanks 28 shown in FIG. 3) to fill with water. A marine vessel (such as the representative marine vessel 26 shown in FIGS. 2 and 3) in need of maintenance or repair is then positioned over the submerged present invention dry-docking lift 2, and conventional water evacuation means (not shown) are used to raise it until the shipyard-supplied cradle apparatus (such as the cradle 22 shown in FIG. 2) supported by platform sections 4 come into contact with the vessel's hull. Once there is certainty that the marine vessel 26 is adequately supported on the shipyard's cradle assembly 22, computerized lifting of platform section or sections 4, cradle 22, and the supported marine vessel 26 in unison to dock/seawall level can begin via conventional jacking units (not shown) located in each lift pod 6 secured to the platform sections 4. Computerized lifting is preferred as it assures the raising of a marine vessel 26 in substantially level orientation. Also, anytime a heavier load is anticipated in an existing or new application, more lifting modules 6 can be secured to platform sections 4 to accommodate it. Marine vessels 26 usable with the present invention dry-docking lift 2 typically require an operating water depth greater than the minimum depth required for present invention use, therefore such issues are usually not a concern. However, the present invention can optionally have a recessed center section (shown in FIG. 1 by the number 12) configured to facilitate shallow water operation. Recessed center area 12 may be integral to platform sections 4 or formed by the removal of reversibly detachable structure (not shown). Optionally also, the present invention dry-docking lift 2 can be configured with one or more pairs of rails 18 and/or locking devices 16 that assist in alignment of the rails 18 in adjacent platform sections 4 prior to welding, and perhaps alignment of rails 18 with other railway configurations at a shipyard during the off-loading process. As an additional option, the platform sections 4 may be open-framed for weight savings. Detailed description of locking devices 16 is not provided herein, as it is contemplated for locking devices 16 to comprise any number of conventional devices needed to fulfill the intended function. Thus, it is contemplated for the locking devices 16 shown in FIG. 1 to be merely representative, and in size, configuration, number, and location of the locking devices 16 used in the present invention to optionally be different from that shown.

Figure 2:
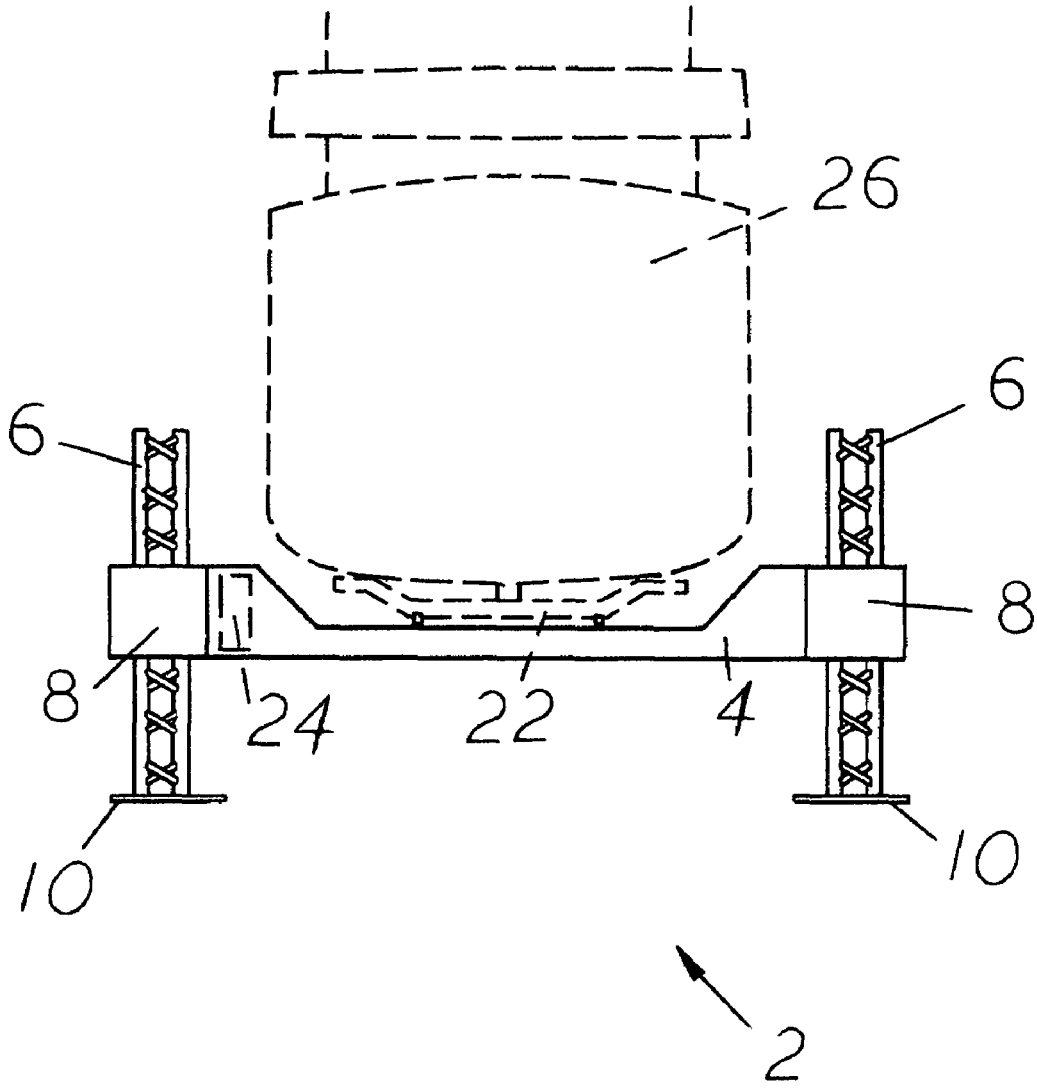
FIG. 2 is an end view of the most preferred embodiment of the present invention having showing it supporting a marine vessel on a cradle within the recessed center area, and one add-on power supply module.
Figure 3:
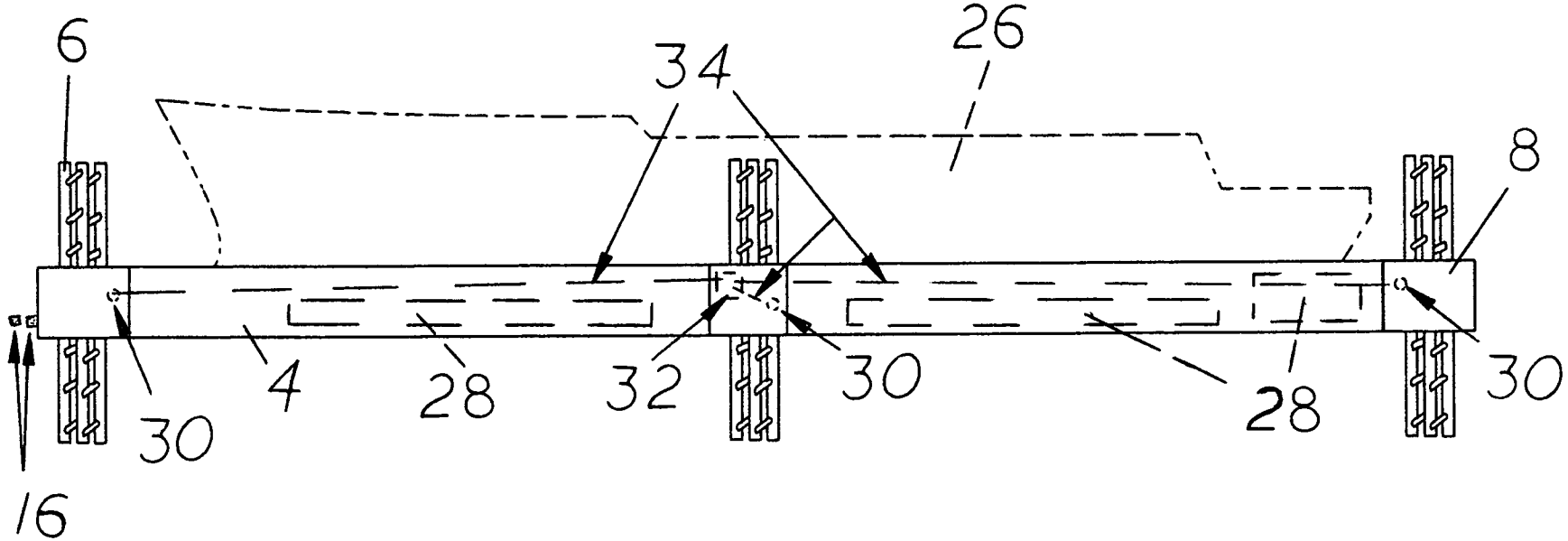
FIG. 3 is a side view of the most preferred embodiment of the present invention having integrated buoyancy and/or hazardous materials storage tanks along its length.

FIGS. 1-3 show the most preferred embodiment of the present invention, with FIG. 1 showing a perspective view, FIG. 2 an end view, and FIG. 3 a side view. FIGS. 1-3 show one platform section 4 and multiple lifting pods 6. More lifting pods 6 than shown can be used where the weight of the marine vessel 26 needing to be lifted to ground level requires more lifting capability. Further, when the length of the marine vessel 26 needing to be lifted to ground level is longer than one platform section 4, multiple platform sections 4 can be added in an end-to-end configuration and welded (or otherwise secured) to accommodate the larger size of vessel 26. Although FIG. 1 shows a platform section having a width dimension less than one-half its length dimension, other width, length, and thickness dimensions are considered to be included within the scope of the present invention as it is contemplated for platform sections 4 to be constructed and combined into any shape or configuration to add or reduce buoyancy, accommodate the lifting of different sizes and shapes of vessels, or to provide a configuration adapted for use at a specific facility (not shown). In addition to platform section 4 and multiple lifting pods 6, FIG. 1 shows platform section 4 having an outwardly-protruding housing/guide 8 for each lift pod 6. Each housing/guide 8 has one lift pod 6 extending through it to guide platform section 4 in its vertical deployment (up or down) in substantially level orientation. Although it is contemplated for at least one housing/guide 8 and lift pod 6 combination to be positioned on each side of platform section 4 at each of its ends, the number of lift pods 6 used may be even greater than the six lift pods 6 shown. Also, the relative size and configuration of each housing/guide 8 can vary from that shown in FIGS. 1-3. Since platform section 4 must be submersible and take on water so that a marine vessel 26 can be positioned over it, housings/guides 8 can also be a part of the structure of present invention dry-docking lift 2 that takes on water and is later subject to pumping for water removal when platform section 4 needs to be raised. While FIGS. 1 and 2 show the bottom portion (pad, pad, or other) 10 of each lift pod 6 to be wider than its upper portion, the relative dimension and configuration used is not considered limiting and may be different from that shown. It is also contemplated for the bottom portion 10 (hereinafter foot/pad 10) of each lift pod 6 to be downwardly extendable to assist in maintaining platform sections 4 in substantial level orientation. Therefore, should one foot/pad 10 sink in a soft seabed, it may be extended an appropriate amount in compensation. However, although not shown, should the present invention dry-docking lift 2 be employed frequently at a particular shipyard with a soft seabed, pads of concrete or other materials (or blocks) could be positioned on the soft seabed to reduce sinking of any or all feet/pads 10 of one or more lift pods 6. Further, feet/pads 10 can be substantially planar (as shown), angled, beveled, or have any other configuration suitable to the composition of the seabed where its use is most commonly anticipated. FIG. 1 also shows a pair of longitudinally-extending rails 18 on the top surface of platform section 4 and locking devices 16 on the near end of platform section 4 adjacent to the ends of rails 18 that can be used as optional guides for railway alignment of one platform section 4 to the next, as well as possible alignment of rails 18 with an adjoining railway system (not shown) used during the marine vessel 26 off-loading process. If use of the present invention dry-docking lift 2 in shallow water is not contemplated, the recessed center area 12 shown in FIGS. 1 and 2 would not be needed, and other rails (such as 18, but not shown) could be used in the top surface of platform section 4 in perpendicular orientation to the rails 18 shown, for off-loading in multiple directions. In off-loading to the side, the top portion of lift pods 6 would have to be positioned to clear the cradle 22 and the hull of the marine vessel 26 supported upon cradle 22. In addition, FIG. 1 shows an add-on generator or propulsion module 20 secured to one side of platform section 4 adjacent to one of the housings/guides 8, while FIG. 2 shows a power supply module 24 positioned at one end of platform section 4 for use in providing power for maintenance and repair work in remote locations and FIG. 3 shows a possible location of one or more storage tanks 28 within platform section 4 that can be used to collect and temporarily contain hazardous materials harmful paint chippings, sand blasting debris, and other hazardous materials and/or debris resulting from maintenance and repair work on a marine vessel 26 supported by present invention dry-docking lift 2. The size, location, configuration, and number of add-on generator or propulsion modules 20, power supply modules 24, and storage tanks 28 used are not considered critical as long as they fulfill their intended functions, and each can be different from that shown. Further, the number of storage tanks 28 that can be reserved for hazardous material containment is dependent at least in part upon the buoyancy requirements needed in a particular application. In the alternative, instead of using independent storage tanks 28 within platform sections 4, it is also considered to be within the scope of the present invention to have walled structures within platform sections 4 that form containment areas for buoyancy and/or storage. FIG. 3 also illustrates a representative configuration for present invention self-leveling, wherein at least one sensor 30 is secured to each lift pod 6 and all sensors 30 used communicate with a computer or microprocessor via electrical wiring 34 or other transmitted communication means (not shown).

Although not shown and where overhead clearances allow, the present invention dry-docking lift 2 can also haul marine vessels 26 into covered areas, and areas otherwise restricted to cranes or other vessel lifting equipment. The present invention also allows dry-docking in covered facilities where cranes cannot operate. Also, unlike all other dry-docking units in current use, the submersible platform sections 4 of the present invention dry-docking lift 2 allow it to be lowered to a harbor or shipyard seabed in the event of a severe storm, hurricane, or tidal surge that substantially reduces the possibility of its damage or destruction. Further, although not shown, a hydrodynamic bow section can be added to the barge-like present invention dry-docking lift 2, for better towing of the invention over long distances and during extreme sea conditions. The present invention dry-docking lift 2 can also be used in remote areas for salvage work to assist in the recovery of sunken vessels, while still having the capability to raise the recovered marine vessel 26 above the water for hull repair. Further, where storage tanks 28 are used to collect toxic materials as they are generated, and contain them temporarily for proper disposal, the immediate work area around the marine vessel 26 would be enclosed and toxins captured by pumping them into one or more storage tanks 28. However, the need for buoyancy and hazardous materials containment needs to be balanced with the desirability of a weight-reducing open-framed structure that can be cost-effective during transport of the present invention to and from remote locations. In addition, the present invention dry-docking lift 2 can also be placed or aligned with various areas of a shipyard seawall or bulkhead for the ability to expand the workable areas or capacity of a shipyard or port facility. A further application of this invention is the ability to remove a holed vessel from the sea to prevent damaged tank areas from further spillage of fuels, black or gray water, oil, or other hazardous materials from spilling into the environment. Contained waste can be later pumped to shore-side hazardous waste containers.

I claim:

1. A portable marine dry-docking lift that can be used for raising yachts, ships, and other marine vessels supported by cradle apparatus at ground level to dry-dock them, said marine dry-docking lift comprising:

at least one submersible platform section having a top surface and an at least partially hollow interior that is configured to take on fluids and have fluids pumped from it to provide needed buoyancy to raise and lower it;

a plurality of elongated lifting modules each oriented, configured, and positioned for vertically raising and lowering said at least one platform section in substantially level orientation, said lifting modules also being spaced-apart from one another for balanced weight distribution of a marine vessel supported upon said top surface; and multiple guide means adapted for association with said at least one submersible platform section and for allowing one of said elongated lifting modules to extend through it so that said at least one submersible platform section is maintained in substantially level orientation during its vertical deployment, said guide means each laterally depending in an outward direction from said top surface, whereby when said top surface of said at least one submersible platform section has cradle apparatus configured for receipt of a marine vessel positioned on it and said at least one submersible platform section is allowed to take on water, both said at least one submersible platform section and the cradle become submerged and thereafter when a marine vessel is moved into a superior position over the cradle and water is pumped from said at least one submersible platform section, it rises until the cradle upon it comes into contact with the superior marine vessel, after which said lifting modules are used to raise the cradle, the vessel, and said at least one submersible platform section in concert to dry-dock the vessel.

2. The marine dry-docking lift of claim 1 wherein said top surface further comprises a recessed center area.

3. The marine dry-docking lift of claim 1 wherein said at least one submersible platform section further comprises at least one tank selected from a group consisting of buoyancy tanks and hazardous material storage tanks.

4. The marine dry-docking lift of claim 1 wherein each said lifting module has a bottom portion configured for extension when a soft seabed is encountered so as to maintain level orientation of said at least one platform section.

5. The marine dry-docking lift of claim 4 wherein each said bottom portion has additional structure selected from a group consisting of feet and pads.

6. The marine dry-docking lift of claim 1 further comprising sensor means adapted for transmitting load information relating to the one of said lifting pods with which it is associated, computer means adapted for receiving and interpreting said load information transmitted by said sensor means, and communication means adapted for facilitating transmission and receipt of information between said sensors and said computer so that substantially level orientation of said at least one platform section is maintained while it supports a marine vessel, and wherein said sensor means are associated with said lifting pods so that each of said lifting pods has at least one of said sensor means associated with it.

7. The marine dry-docking lift of claim 1 further comprising at least one pair of rails associated with said top surface, said rails being configured and positioned to assist the off-loading movement of a cradle-supported marine vessel from said top surface after said at least one submersible platform section is raised to ground level.

8. The marine dry-docking lift of claim 7 wherein said at least one submersible platform section has an end, and further comprising at least one locking device on said end adjacent to said at least one pair of rails, with said at least one said locking device configured and positioned for railway alignment of said rails during off-loading of a cradle-supported marine vessel from said at least one submersible platform section.

9. The marine dry-docking lift of claim 7 further comprising at least two pair of rails associated with said top surface, with at least one of said pairs of rails in perpendicular orientation to a second one of said pairs of rails to allow for multi-directional off-loading of cradle-supported marine vessel from said at least one submersible platform section.

10. The marine dry-docking lift of claim 1 further comprising at least one add-on propulsion module adapted for self-contained movement of said at least one platform section between usable locations.

11. The marine dry-docking lift of claim 1 further comprising at least one power supply module configured for supplying power for maintenance and repair work on a marine vessel supported upon said top surface of said at least one submersible platform section.

12. The method of claim 1 wherein said step of providing further comprises the providing of at least one add-on propulsion module adapted for self-contained movement of said at least one platform section between usable locations, and the step of using said at least one add-on propulsion module for independent movement of said at least one platform section between usable locations.

13. The method of claim 1 wherein said step of providing further comprises the providing of at least one power supply module configured for supplying power for maintenance and repair work on a marine vessel supported upon said top surface of said at least one submersible platform section, and the step of using said at least one power supply module configured for supplying power for maintenance and repair work on a marine vessel supported upon said top surface.

14. A method of raising yachts, ships, and other marine vessels supported by cradle apparatus to ground level to dry-dock them, said method comprising the steps of:

providing at least one submersible platform section having a top surface and an at least partially hollow interior configured to take on fluids and have fluids pumped from it, a plurality of elongated lifting modules, and multiple guide means adapted for allowing one of said elongated lifting modules to extend through it;

associating said multiple guide means with said at least one submersible platform section for balanced weight distribution of a marine vessel supported upon said top surface and so that said guide means each laterally depend in an outward direction from said top surface;

positioning one of said lifting modules through each of said guide means so that said at least one platform section is in substantially level orientation;

evacuating sufficient water from said at least one submersible platform section to make it buoyant; and using said lifting modules in concert to raise said at least one submersible platform section to dry-dock the marine vessel supported upon said top surface.

15. The method of claim 14 wherein said top surface further comprises a recessed center area.

16. The method of claim 14 wherein each said lifting module further comprises a bottom portion configured for extension when a soft seabed is encountered and further comprising the step of extending said bottom portion to maintain level orientation of said at least one platform section.

17. The method of claim 14 wherein said step of providing further comprises the providing at least one pair of rails associated with said top surface and the step of positioning said rails so as to assist the off-loading movement of a cradle-supported marine vessel from said top surface after said at least one submersible platform section is raised to ground level.

18. The method of claim 17 wherein said at least one submersible platform section has an end and said step of providing further comprises the providing of at least one locking device on said end, and further comprising the step of positioning said at least one said locking device for railway alignment of said rails during off-loading of a cradle-supported marine vessel from said at least one submersible platform section.

19. The method of claim 17 wherein said step of providing further comprises the providing at least two pair of rails associated with said top surface, and further comprising the step of positioning at least one of said pairs of rails in perpendicular orientation to a second one of said pairs of rails so as to allow for multi-directional off-loading of a cradle-supported marine vessel from said at least one submersible platform section.

* * * * *